United States Patent [19]

Hunt, Jr. et al.

[11] 4,019,732

[45] Apr. 26, 1977

[54] SHEET REGISTRATION MECHANISM

[75] Inventors: Clayton Edward Hunt, Jr., Rochester; Donald James Spooner, Webster, both of N.Y.

[73] Assignee: Eastman Kodak Company, Rochester, N.Y.

[22] Filed: July 2, 1976

[21] Appl. No.: 702,314

[52] U.S. Cl. ..... 271/245; 271/253

[51] Int. Cl.[2] ..... B65H 9/06

[58] Field of Search ..... 271/245, 246, 243, 242, 271/235, 253, 254, 255, 236, 226, 227, 247

[56] References Cited

UNITED STATES PATENTS

| | | | |
|---|---|---|---|
| 3,015,485 | 1/1962 | Smith | 271/246 |
| 3,072,397 | 1/1963 | Kelchner | 271/245 |

*Primary Examiner*—Evon C. Blunk
*Assistant Examiner*—Bruce H. Stoner, Jr.
*Attorney, Agent, or Firm*—L. P. Kessler

[57] ABSTRACT

A registration mechanism for feeding sheets seriatim including a plurality of continuously driven roller sets located along a sheet feed path. A first roller set receives the sheets seriatim and moves the sheets toward a second roller set. The second roller set includes a pair of axially spaced, continuously driven rollers mounted on a drive shaft and a pair of thrust washers which sandwich a registration disc therebetween, the disc being freely mounted on the roller drive shaft. The registration disc has a registration finger which selectively extends through the sheet feed path. When the finger is positioned to extend through the feed path, it is latched to prevent rotation of the disc and provide registration of the sheets fed by the first roller set against the finger. At predetermined time intervals, the finger is unlatched and due to the action of the thrust washers on the disc, the disc is rotated with the driven rollers to move the finger out of the sheet feed path to enable the sheet to be fed by the rollers in registration to a downstream processing station.

7 Claims, 5 Drawing Figures

SHEET REGISTRATION MECHANISM

BACKGROUND OF THE INVENTION

1. Field of the Invention

This invention relates to sheet feeding apparatus and more particularly to a registration mechanism for an apparatus for sheets fed seriatim.

2. Description of the Prior Art

In certain types of high speed reproduction equipment such as printing presses and electrophotographic copying machines, it has been a general practice to make copies on individual sheets of material. This eliminates the time (and aparatus) needed to process a web into cut sheets of desired size. The individual sheets are fed from a hopper seriatim along a delivery path to a printing plate bearing an ink or toner image. Since the plate may be moving relative to the path of the cut sheets, the movement of the sheets must be coordinated with the movement of the plate to insure registration of a sheet with an image to be copied. A registration mechanism, provided in the delivery path, typically includes a member which intercepts the delivery path and is contacted by the individual sheets as they are fed seriatim from the hopper. The member, which may be, for example, a gate or a roller, will stop the sheets (or at least slow the movement thereof) for the purpose of alignment, and then at a proper time release the sheets to be fed to the printing plate in registration with the image thereon. To enable the reproduction equipment to operate at high speed, a continuously operating drive moves the sheets into contact with the registration mechanism at a speed greater than the timed speed of movement necessary for the sheet to have proper registration with the image to be copied. This may cause the sheets to buckle, which in turn effects the degree of accuracy of registration in that upon release by the registration mechanism, the sheets will have variable spring-out forces induced by the buckle.

SUMMARY OF THE INVENTION

It is the purpose of this invention to provide a mechanism for accurate, repeatable registration of sheets fed seriatim, the apparatus being of simple construction capable of high speed operation. The registration mechanism includes a plurality of continuously driven roller sets located along a sheet feed path. A first roller set receives the sheets seriatim and moves the sheets toward a second roller set. The second roller set includes a pair of axially spaced, continuously driven rollers mounted on a drive shaft and a pair of thrust washers which sandwich a registration disc therebetween, the disc being freely mounted on the roller drive shaft. The registration disc has a registration finger which selectively extends through the sheet feed path. When the finger is positioned to extend through the feed path, it is latched to prevent rotation of the disc and provide registration of the sheets fed by the first roller set against the finger. At predetermined timed intervals, the finger is unlatched and due to the action of the thrust washers on the disc, the disc is rotated with the driven rollers to move the finger out of the sheet feed path to enable the sheet to be fed by the rollers in registration to a downstream processing station.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
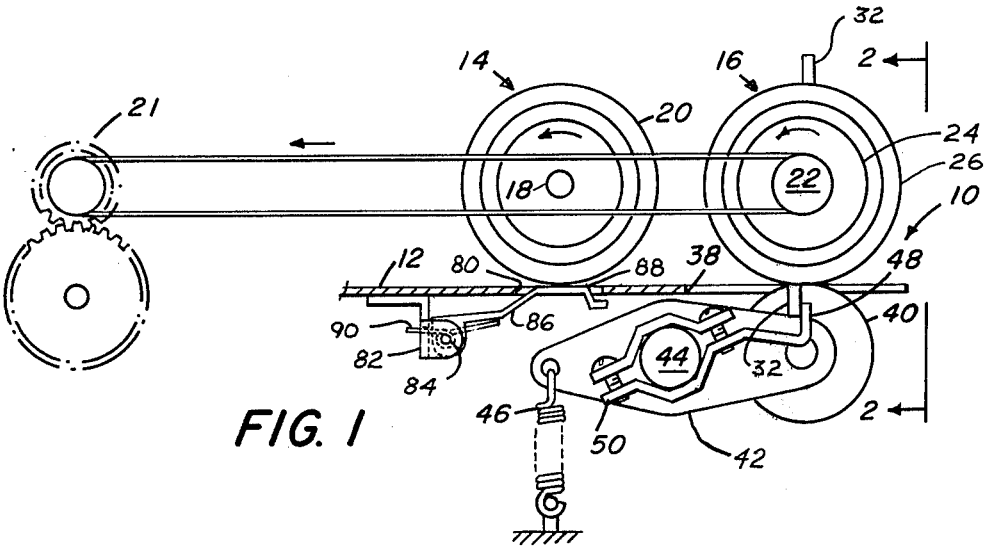
FIG. 1 is a side elevational view, partly in section, of the registration mechanism of this invention.
Figure 2:
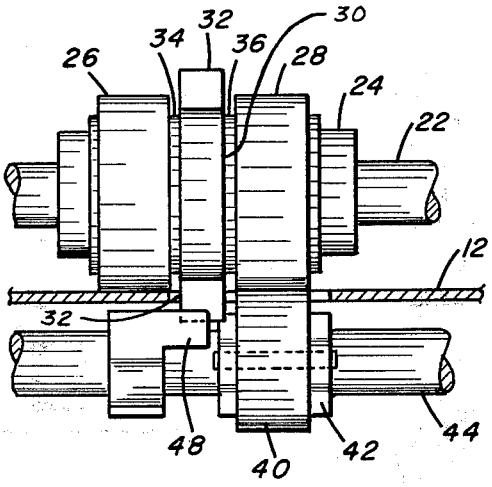
FIG. 2 is a front elevational view of a portion of the registration mechanism, partly in section, taken generally on the lines 2—2 of FIG. 1.

The registration mechanism 10 of this invention, as shown in FIGS. 1 and 2, serves as a timing device for feeding sheets seriatim in a predetermined time relationship, as for example in a copying apparatus from a supply hopper to a moving photoconductor bearing a toner image. The mechanism 10 includes a support 12 which receives sheets fed seriatim from an upstream supply (not shown) and defines at least a portion of a sheet travel path. An urging roller set 14 feeds the sheets along the support 12 to an integrated roller set 16. Although only one urging roller set 14 and one integrated roller set 16 are shown in the side elevational view of FIG. 1, at least two of each of the roller sets are generally provided across the sheet travel path.

The surface of the roller in the urging roller set 14 is preferably an open celled foam material 20 capable of developing the necessary friction force on a sheet to move the sheet without damage thereto along the portion of the sheet path defined by support 12. The roller set 14 which is of a preselected diameter, is mounted on a shaft 18 located above the support 12. The integrated roller set 16 is driven by a drive mechanism 21 drivingly connected with a shaft 22 supporting the roller set 16. The shaft 22 is located above the support 12 at the same general elevation as shaft 18. The shaft 18 is interconnected with the shaft 22 by any suitable means (such as a gear train, not shown) to rotate the urging roller set 14 in the same direction and at the same speed as the integrated roller set.

To enable the urging roller set 14 to accommodate a wide variety of paper weights with a minimum of criticality in its adjustment relative to the support 12, the roller set 14 is located above an opening 80 in the support 12. A bracket 82, which is fixed to the underside of the support 12 adjacent the opening 80, carries a pivot pin 84. A backing member 86 is mounted for free pivoting movement about the pin 84. The member 86 has a planar surface 88 extending through the opening 80 forming a sheet guide surface. A torsion spring 90 supported by the pin 84 biases the member 86 into engagement with the roller set 14 such that a nip is formed between the surface 88 and the roller set. The spring force exerted by the spring 90 establishes a substantially constant nip pressure for any particular paper weight of a sheet being registered by the mechanism 10.

Figure 3:
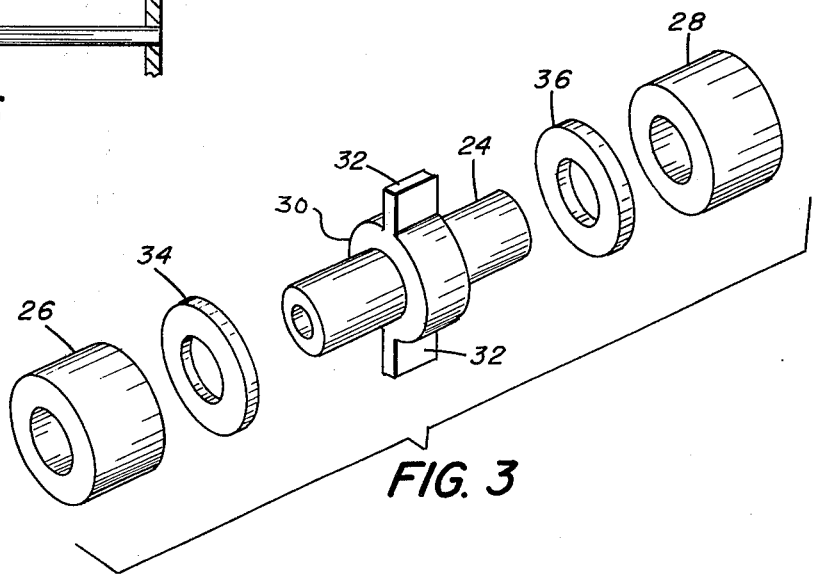
FIG. 3 is an exploded view of the integrated roller set of the registration mechanism of this invention.

The integrated roller 16 set, which is shown in detail in the exploded view of FIG. 3, includes a hub 24 integrally mounted on the shaft 22. A pair of spaced apart rollers 26 and 28 are fixed to the hub 24 for rotation therewith. The roller 26 is of foam material similar to that of the roller of the urging roller set 14 while roller 28 is preferably of a solid rubber-like material having a durometer hardness of about 60 to 80 to provide a more positive friction drive for the sheets. The rollers 26 and 28 are also of a preselected diameter such that they will develop the necessary friction forces to move a sheet along its travel path on support 12 without damaging the sheet. A registration disc 30, having a pair of registration fingers 32, is located between the rollers 26 and 28 is supported by the hub 24 but is free to rotate relative thereto. The registration fingers 32 of the disc 30 are substantially diametrically opposed and are located just upstream of the diameter of the disc. Thrust washers 34, 36 are located between the rollers 26 and 28 and the disc 30 so as to maintain an axial loading force on the disc from the rollers. The roller 28 is located above an opening 38 in the support 12 and is opposed by a pinch roller 40 of similar material. The pinch roller 40 is carried by an arm 42 which is supported on a shaft (located below the support 12) for free pivotable movement thereabout. The roller 40 is urged into engagement with the roller 28 by a spring 46 which biases the arm 42 in a counterclockwise direction about the shaft 44 (when viewed in the direction of FIG. 1).

Figure 4:
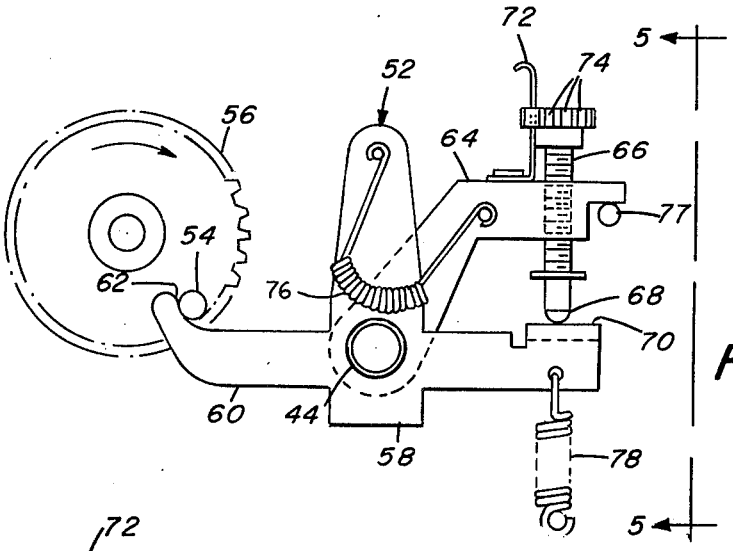
FIG. 4 is a side elevational view of the registration latch trip mechanism.
Figure 5:
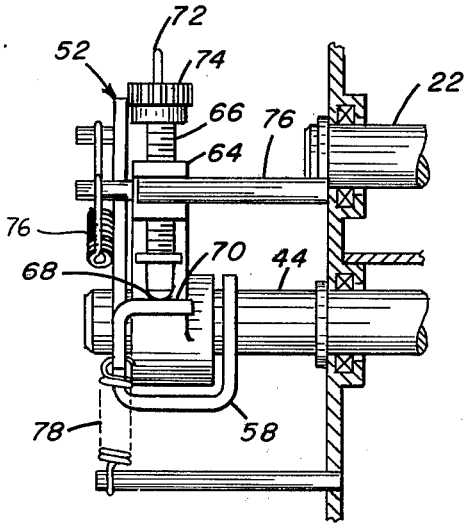
FIG. 5 is a rear elevational view of the registration latch trip mechanism, taken generally on the lines 5—5 of FIG. 4.

In order to selectively immobilize the disc 30 of the integrated roller set 16, a latch 48 engageable with the fingers 32 is secured to the shaft 44 by a clamp 50. The latch 48 is controlled by a registration trip mechanism 52 (FIGS. 4 and 5) which periodically releases the latch by imparting oscillation to the shaft 44. The registration trip mechanism 52 is actuated by a pin 54 on gear 56 which is driven in synchronism with the approach of a toned image in the copy apparatus (not shown). The gear 56 is driven at a speed of one revolution per cycle of the copying apparatus, i.e., one revolution per image appearing of the photoconductor in a copy station. The trip mechanism 52 includes a bracket 58 supported on the shaft 44 for free pivotable movement with respect to the shaft. The bracket 58 has an integral lever 60 extending into the path of and engageable by the pin 54. The upper surface 62 of the forward end on the level 60 is curved to establish a substantially constant velocity of motion of the lever when moved by the pin 54 as the angular position of the pin changes.

A second lever 64, adjustably interrelated with the bracket 58 and fixed to the shaft 44 serves to impart the oscillatory movement of the bracket to the shaft 44. An adjustment screw 66 is threaded through lever 64 and has a lead end 68 acting on a laterally extending portion 70 of the bracket 58, theeby determining the initial angular position of the shaft 44 and thus the contact surface between the latch 48 and the fingers 32. A detent spring 72 mounted on the lever 64 engages notches 74 in the screw 66 to prevent screw 66 from moving in response to vibration. A spring 76 interconnected between the bracket 58 and the lever 64 biases the lever 64 in a clockwise direction (as viewed in FIG. 4) relative the bracket 58 to maintain the lead end 68 in positive engagement with the bracket portion 70. The trip mechanism 52 is biased to its rest position against a stop 77 by a spring 78 connected to the portion 70 to normally position the latch 48 in the path of the fingers 32. As will now be appreciated, movement of the lever 60 (and thus the bracket 58) by the pin 54 will be directly transmitted to the lever 64 to oscillate the shaft 44 and move the latch out of the path of the finger. The amount of contact between the latch 48 and the finger 32 will determine the angular degree of oscillation of the shaft 44 necessary for the finger to be released.

With the construction of the registration mechanism 10 thus described, the operation is as follows: The drive mechanism 21 is actuated to rotate the integrated roller set 16 which in turn drives the urging roller set 14. When the copying apparatus is activated, a sheet is fed from a supply onto the support 12 and urged by the roller set 14 against the registration finger 32 of the disc 30. The disc 30 (and thus the finger 32) is maintained in a sheet path blocking position by the latch 48 which prevents rotation of the disc by the roller 26 and 28 through the thrust washers 34 and 36. Since the roller sets 14 and 16 are constantly driven, the roller set 14 will urge the sheet against the finger 32 to register the sheet and remove any misalignment thereof. As noted above, the material 20 of the roller set 14 and its location above the backing member 86 will enable the roller to slip on a registered sheet rather than causing the sheet to buckle-up between roller sets 14 and 16. Due to the position of the fingers 32 on the disc 30 (upstream of the disc diameter), the sheet will be stopped just upstream of the nip formed between the rollers 26 and 28 of the integrated roller set 16 and the support 12 and pinch roller 40, thereby preventing damage to the lead end of the sheet. Each sheet will remain in its stopped location until the finger 32 is released, the release being timed by the rotation of the gear 56 interrelated to the arrival of a toner image at a downstream location.

Release of the finger 32 by timed pivoting of the latch 48, will free the finger from constraints on its rotary motion. While timing of actuation of the trip mechanism 52 to pivot the latch 48, is generally set by the tripping of lever 60 by the pin 54 (carried by the gear 56), the precise point in the feed cycle which the finger 32 is released is determined by the position of the screw 66; screw 66 sets the angular relationship between the bracket 58 and the lever 64 supporting the screw, and the resulting surface contact between the finger and the latch. The length of the surface contact between finger 32 and latch 48 measured radially of disc 30 determines the degree of rotation of the shaft 44 necessary before the latch 48 disengages the finger 32.

Due to the axial loading of the thrust washers 34, 36 and the disc 30, when the finger 32 is released the disc 30 is rotated by frictional engagement with the rollers 26 and 28. This permits a sheet to be fed into the nip of the integrated roller set 16 and the pinch roller 40 so to arrive in contact with and in proper timed registration to a toned image in a downstream transfer or printing station (not shown). As soon as the pin 54 passes the lever 60, the trip mechanism will be returned to its rest position against stop 77 by the spring 78. The latch 48 will thus be in position to engage the opposite finger 32 as it rotates around with the rollers 26 and 28. However, prior to such engagement the opposite finger will slip on the surface of the just fed sheet leaving the nip of integrated roller sets 16. When the finger engages the latch 48 the rotation of the disc 30 will again be arrested and will slip relative to the rollers 26 and 28. The finger will thus be in sheet blocking position for the next sheet fed to the urging roller set 14 to register and align this subsequent sheet. The operation is repeated for each toned image arriving in the transfer station.

From the foregoing it is apparent that there is herein provided a registration mechanism of simple construction which repeatably registers and times the feeding of sheets seriatim to, for example, the transfer station of a copying aparatus. The mechanism urges each sheet against a latched finger which is selectively released from a sheet path blocking position at a predetermined time to permit the sheet to be fed in timed registration to a downstream location. The finger is dependent from a disc under axial loading by thrust washers from continuously rotating feed rollers. An adjustable trip mechanism actuates a latch release at timed intervals to enable the disc to be rotated out of the sheet path blocking position clearing the sheet path for registered feeding movement of the sheet.

The invention has been described in detail with particular reference to preferred embodiment thereof, but will be understood that variations and modifications can be effected within the spirit and scope of the invention.

We claim:

1. A sheet registration mechanism comprising: a support establishing a travel path for sheets; means for urging such sheets seriatim along said support in said travel path; means downstream of said urging means for registering and feeding such sheets at a precise point in a predetermined time cycle for sheet movement in said travel path, said registering and feeding means including a continuously rotating feed roller mounted on a drive shaft and a pinch roller mounted in engagement with said feed roller to form a nip for feeding a sheet therebetween, a rotatable registration disc for selectively intercepting and at least momentarily stopping a sheet in said travel path upstream of said feed roller, and means for axially loading said registration disc into frictional driving engagement with said feed roller; means for selectively latching said registration disc to prevent rotation of said registration disc by said feed roller when said registration disc is in position to intercept a sheet; and adjustable means for unlatching said latching means to release said registration disc at said precise point in said time cycle whereby said registration disc may be rotated out of said sheet intercepting position enabling said feed roller to feed the intercepted sheet.

2. The invention of claim 1 wherein said registration disc is mounted on said drive shaft for rotation relative thereto, and includes at least one registration finger extending outwardly from said registration disc for engaging the leading edge of an intercepted sheet.

3. The invention of claim 2 wherein said registration finge, when positioned to engage the leading edge of an intercepted sheet, is located in said travel path just upstream of said nip.

4. The invention of claim 3 wherein said latching means comprises a latch member pivotally mounted for engagement with said one finger to prevent rotation of said registration disc; and wherein said adjustable unlatching means comprises a first lever coupled to said latch member to pivotal movement with said latch member, a second lever mounted for pivotable movement relative to said first lever, and adjustment means for determining the angular relationship between said first and second levers and thus the length of surface engagement between said latch member and said finger to thereby adjustably determine the precise point in said time cycle at which said finger is released by said latching means.

5. The invention of claim 4 wherein said adjustment means comprises a screw threadably received by said first lever and having a lead end for contacting said second lever, means for biasing said first lever toward said second lever to maintain said lead end of said screw in contact with said second lever, and means for selectively locking said screw in any predetermined position to maintain the selected angular relationship between said first lever and said second lever.

6. The invention of claim 5 wherein said adjustable unlatching means further comprises a pin, and means for cyclically driving said pin to periodically engage and impart pivotal movement to said second lever, the cyclical drive of said pin being directly related to said time cycle.

7. The invention of claim 6 wherein said registration mechanism further comprises means for establishing substantially constant pressure in the nip of said urging means, said establishing means comprising a backing member extending through an opening in said support adjacent to said urging means to form a nip therewith, and means for applying a substantially constant force to said backing member to bias said backing member against said urging means.

* * * * *